US006944394B2

(12) United States Patent
Long et al.

(10) Patent No.: US 6,944,394 B2
(45) Date of Patent: Sep. 13, 2005

(54) RAPID RESPONSE ELECTRIC HEAT EXCHANGER

(75) Inventors: Dennis P. Long, Monroe City, MO (US); Christopher W. Cozort, Clayton, CA (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 200 days.

(21) Appl. No.: 10/053,968

(22) Filed: Jan. 22, 2002

(65) Prior Publication Data

US 2003/0138244 A1 Jul. 24, 2003

(51) Int. Cl.[7] ..... F24H 1/10
(52) U.S. Cl. ..... 392/485; 392/465; 392/480
(58) Field of Search ..... 392/465, 466, 392/485, 480, 491, 492

(56) References Cited

U.S. PATENT DOCUMENTS

| | | | | |
|---|---|---|---|---|
| 2,878,360 A | * | 3/1959 | Tavender et al. | 239/75 |
| 3,835,294 A | | 9/1974 | Krohn et al. | |
| 3,916,991 A | | 11/1975 | Trump | 165/163 |
| 4,501,952 A | * | 2/1985 | Lehrke | 392/491 |
| 5,013,890 A | | 5/1991 | Gamble | 392/497 |
| 5,178,651 A | * | 1/1993 | Balma et al. | 95/10 |
| 5,198,641 A | | 3/1993 | Nagano et al. | 219/544 |
| 5,245,160 A | | 9/1993 | Quabeck et al. | 219/471 |
| 5,497,824 A | | 3/1996 | Rouf | 165/1 |
| 5,590,240 A | | 12/1996 | Rezabek | 392/483 |
| 5,774,627 A | | 6/1998 | Jackson | 392/497 |
| 5,875,283 A | | 2/1999 | Yane et al. | 392/497 |
| 5,909,535 A | | 6/1999 | Curwick et al. | 392/476 |
| 6,031,207 A | | 2/2000 | Dover et al. | 219/405 |
| 6,068,703 A | * | 5/2000 | Chen et al. | 118/715 |
| 6,142,707 A | | 11/2000 | Bass et al. | 405/158 |
| 6,149,814 A | | 11/2000 | Allington et al. | 210/634 |
| 6,157,778 A | | 12/2000 | Kadotani | 392/483 |
| 6,516,142 B2 | * | 2/2003 | Grant et al. | 392/451 |

FOREIGN PATENT DOCUMENTS

| | | |
|---|---|---|
| GB | 1095265 | 12/1967 |
| GB | 2224103 | 4/1990 |
| GB | 2265445 | 9/1993 |

OTHER PUBLICATIONS

Electronic Heating Solutions To Cleaning Problems, Watlow Electric Manufacturing Company, 1999.
Employ Immersion Heaters Properly, Chemical Engineering Progress, Robert C. Klein, Aug. 1993.
316 Stainless Steel Heaters, HAN–316–SS–54, Watlow Industries.

* cited by examiner

*Primary Examiner*—Thor S. Campbell
(74) *Attorney, Agent, or Firm*—Harness, Dickey & Pierce, P.L.C.

(57) ABSTRACT

A fluid heat exchanger for use in a fluid heating system is disclosed that includes a rapidly heatable inside tube surrounded by a hollow outside tube for heating a fluid flowing between the inside tube and the outside tube for circulation through the fluid heating system. When the inside tube is rapidly heated, the circulated fluid is rapidly heated to a predetermined temperature for use in the fluid heating system.

33 Claims, 9 Drawing Sheets

THERMAL PROPERTIES OF AIR @ VARIOUS TEMPERATURES & 500 psig

| TEMPERATURE, F | 68 | 216 | 500 | 1000 |
|---|---|---|---|---|
| SPECIFIC HEAT CAPACITY, Cp | .241 | .243 | .250 | .264 |
| THERMAL CONDUCTIVITY, K | .0134 | .0143 | .0157 | .0180 |
| VISCOSITY, ABSOLUTE, $\mu$ | .0442 | .0540 | .0715 | .0977 |
| DENSITY, $\rho$ | 2.62 | 2.06 | 1.43 | 0.94 |

$C_p$=BTU/lb-°F
K=BTU/Ft-hr-°F
$\mu$=lb/Ft-hr
$\rho$=lb/Ft$^3$

FIG. 17

RAPID RESPONSE ELECTRIC HEAT EXCHANGER

BACKGROUND OF THE INVENTION

1. Field of the Invention

The present invention relates to a heat exchanger, and more particularly to a fluid heat exchanger. More specifically, the present invention relates to a fluid heat exchanger for rapidly heating a fluid passing between two tubes of the heat exchanger.

2. Known Art

Typically, fluid heating systems are comprised of a metal resistive coil, referred to as a heating element, which winds around the outside of a hollow tube. A fluid flows through the tube and is heated by the heating element; however, this construction has several drawbacks. Prior art heating systems do not efficiently heat the fluid, especially at low fluid flow rates. Further, such heating systems are not easily formed into a compact shape and require an excessive period of time to heat the fluid to a desired temperature for use in fluid heating system.

An advance in the art is found in U.S. Pat. No. 5,590,240 to Rezabek which discloses a fluid heating system that includes an insulated housing containing longitudinally proceeding high efficiency tubular heat exchangers. These tubular heat exchangers have inner and outer helical passageways and a return passageway proceeding along a longitudinal axis through the helical passageways which are in fluid communication with each other. A heat transfer fluid, such as ultra pure water, sequentially passes through each of the helical passageways before passing through the return passageway. The inner helical passageway has resistance coils intermittently wrapped about its periphery for heating the heat transfer fluid. However, the Rezabek heating system requires the heat transfer fluid to travel the length of the housing at least three times to achieve greater fluid heating efficiency. In addition, due to the amount of required spacing between the tubing, the Rezabek system lacks a compact construction, nor is the Rezabek system easy to manufacture. Therefore, there appears a need in the art for a fluid heating system that is compact in construction, easy to manufacture, and rapidly brings the fluid temperature to a desired temperature level in an efficient manner.

SUMMARY OF THE INVENTION

Among the several objects, features and advantages of the present invention is to provide a fluid heat exchanger that heats fluid much more efficiently than the known prior art.

Another feature of the present invention is to provide a fluid heat exchanger that rapidly heats fluid to a desired temperature level for use in a fluid heating system.

A further feature of the present invention is to provide a fluid heat exchanger of compact construction.

An additional feature of the present invention is to provide a fluid heat exchanger that is easy to manufacture.

Yet a further feature of the present invention is to provide a fluid heat exchanger that may be formed in virtually any shape.

Another further feature of the present invention is to provide a fluid heat exchanger that is capable of maintaining a fluid in a supercritical state.

These and other objects of the present invention are realized in the preferred embodiment of the present invention, described by way of example and not by way of limitation, which provides for a fluid heat exchanger having a novel arrangement for heating a fluid by passing the fluid between a heated tube and a surrounding outer tube.

In brief summary, the present invention overcomes and substantially alleviates the deficiencies in the prior art by providing a fluid heat exchanger for use in a fluid heating system comprising a housing which encases a body including a rapidly heatable inside tube surrounded by a hollow outside tube. A fluid is passed between the inside tube and the outside tube for circulation through the fluid heating system wherein the inside tube is rapidly heated so that the fluid is nearly instantaneously brought to a predetermined temperature for use in the fluid heating system.

To regulate the temperature of the fluid within a predetermined temperature range, a temperature control system is utilized. The temperature control system includes at least one sensor located along the fluid heat exchanger to sense the temperature of the passing fluid. If the fluid temperature level is below the predetermined temperature range set by the temperature control system, the temperature control system selectively applies electrical power from an electrical power source to opposing ends of the inside tube. Since the inside tube is comprised of an electroresistive material, the application of electrical power energizes the inside tube which causes the inside tube to become heated to raise the temperature of the fluid passing between the inside and outside tubes. When the fluid temperature is raised to a level that is within the predetermined temperature range, the temperature control system removes electrical power from the opposing ends of the inside tube which de-energizes the inside tube and causes the inside tube to cool. The temperature control system continually monitors the fluid temperature and selectively energizes the inner tube to maintain the fluid temperature within the predetermined temperature range.

In one embodiment of the fluid heat exchanger, the fluid may reach a supercritical state for use in the fluid heating system.

Additional objects, advantages and novel features of the invention will be set forth in the description which follows, and will become apparent to those skilled in the art upon examination of the following more detailed description and drawings in which like elements of the invention are similarly numbered throughout.

BRIEF DESCRIPTION OF THE DRAWINGS

FIG. 17 is a table illustrating various fluid parameter values at various temperature levels for air at 500 psig.

Corresponding reference characters identify corresponding elements throughout the several views of the drawings.

DESCRIPTION OF PRACTICAL EMBODIMENTS

Figure 4:
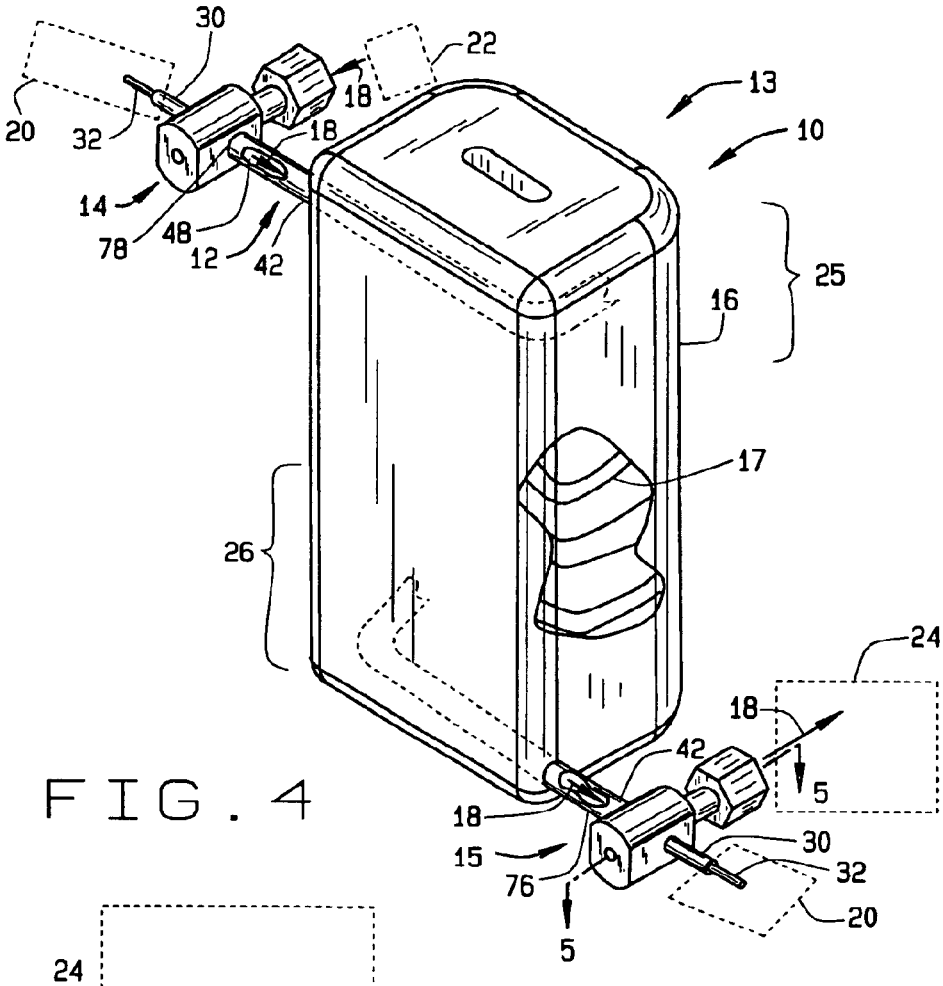
FIG. 4 is a perspective view of a fluid heating system according to the present invention.

Referring to the drawings, the preferred embodiment of the fluid heating system of the present invention is illustrated and generally indicated as 10 in FIG. 4. Fluid heating system 10 comprises a housing 13 which encases a body 17 defining elongated upper and lower portions 25, 26 having a fluid heat exchanger 12 disposed therein which provides a means for heating a fluid 18 to a predetermined temperature. Fluid 18 entering upper portion 25 from a return side 22 of fluid heating system 10 is heated as fluid 18 flows along upper and lower portions 25, 26. Heated fluid 18 then exits lower portion 26 and flows into an inlet side 24, and through the remaining portion of fluid heating system 10. Once circulated, fluid 18 flows through return side 22 wherein the sequence is again repeated. The temperature level of fluid 18 is maintained by a temperature control system 20.

Figure 1:
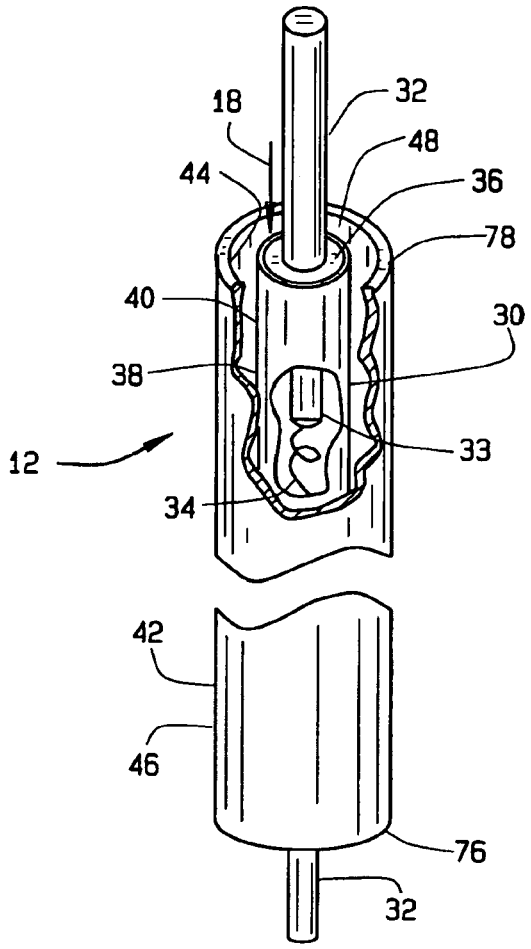
FIG. 1 is a partial fragmentary perspective view of a fluid heat exchanger according to the present invention.

Referring to FIGS. 1 and 4, fluid heat exchanger 12 is comprised of a rapidly heatable elongated inside tube 30 having a distal end 76 and a proximal end 78 surrounded by a similarly elongated outside tube 42 for heating fluid 18 passing therebetween from both the distal and proximal ends 76, 78. Fluid heat exchanger 12 is connected to an upper fitting 14 for receiving fluid 18 from return side 22 and to a lower fitting 15 for transporting fluid 18 to the inlet side 24 of the fluid heating system 10. Substantially encasing outside tube 42 between fittings 14 and 15 is an insulation layer 16. Heatable inside tube 30 includes a cold portion 32 which extends outwardly from both the distal and proximal ends 76, 78 of inside tube 30 for connection with an electrical power source (not shown). A coiled hot portion 34 is attached to one end of each cold portion 32 at a splice 33. Preferably, coiled hot portion 34 is composed of an electroresistive material so that hot portion 34 generates heat in response to an electrical current being applied to both cold portions 32. This application of electrical current "energizes" fluid heat exchanger 12, and subsequent removal of electrical current "de-energizes" fluid heat exchanger 12. Surrounding coiled hot portion 34, and partially surrounding each cold portion 32, is a heat conductive filler material 36, such as magnesium oxide. An outer sheath 38 surrounds filler material 36 which defines an outer surface 40 that contacts fluid 18. Preferably, outside tube 42 is concentrically spaced closely around outer surface 40 of outer sheath 38 and includes an inside surface 44 and an outside surface 46. Outside surface 40 and inside surface 44 collectively define a passageway 48 of preferably small annular cross-sectional area for the flow of fluid 18 which is heated by coiled hot portion 34 as it passes along passageway 48 when electric power is applied to each cold portion 32.

Figure 2:
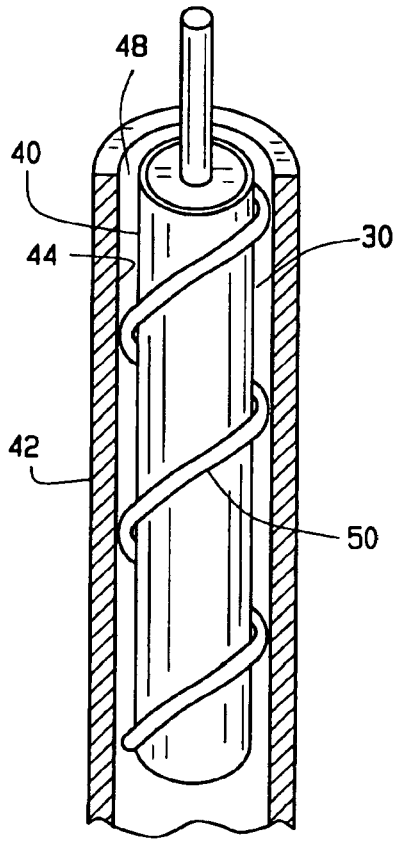
FIG. 2 is a partial cutaway perspective view of the fluid heat exchanger according to the present invention.

Referring to FIG. 2, a wire 50 may be coiled along outer surface 40 of inside tube 30 prior to insertion into outside tube 42 during manufacturing. Preferably, the diameter of wire 50 should be sized so that outside tube 42 barely slides over inside tube 30. The coiled arrangement of wire 50 between inside tube 30 and outside tube 42 substantially maintains the concentricity between inside tube 30 and outside tube 42 as fluid heat exchanger 12 is formed into a desired shape as may be required for a particular application. Further, wire 50 defines a helical path for fluid 18 to flow within passageway 48, thereby increasing the heating efficiency of fluid 18 as it is heated by inside tube 30.

Figure 3A:
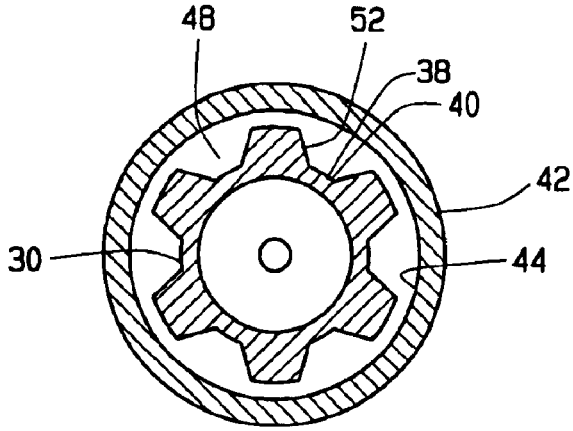
FIG. 3A is a cross-sectional view of an alternate embodiment of the fluid heat exchanger according to the present invention.
Figure 3B:
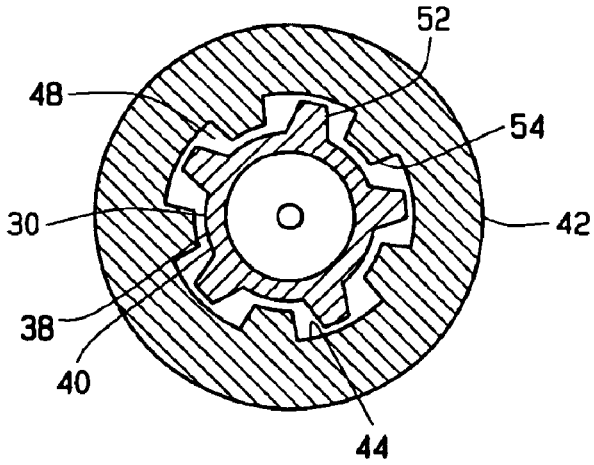
FIG. 3B is a c ross-sectional view of alternate embodiment of the fluid heat exchanger according to the present invention.
Figure 3C:
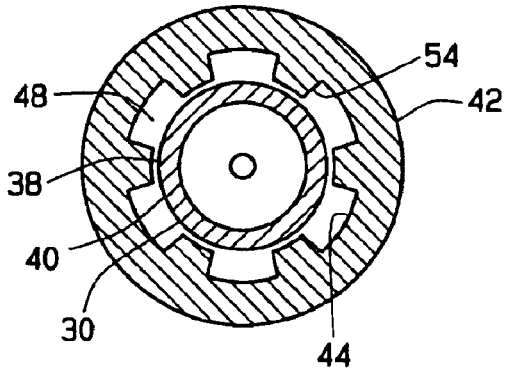
FIG. 3C is a cross-sectional view of a further alternate embodiment of the fluid heat exchanger of the present invention.

Referring to FIG. 3A, an alternate arrangement may be utilized to maintain concentricity between inside tube 30 and outside tube 42. Instead of wire 50, the alternate embodiment defines numerous raised regions 52 which extend radially outward from outer surface 40 of inside tube 30. To permit insertion of inside tube 30 inside outside tube 42, the outer diameter along inside tube 30 including opposed raised regions 52 should be slightly less than the inner diameter of inside surface 44. Accordingly, substantial concentricity between inside tube 30 and outside tube 42 is maintained as fluid heat exchanger 12 is formed for a particular application during manufacturing. Similarly, FIGS. 3B and 3C disclose alternate embodiments of the construction shown in FIG. 3A. In FIG. 3B, in addition to raised regions 52 extending from outer surface 30, raised regions 54 are provided along inside surface 44 that extend radially inwardly from outside tube 42. In FIG. 3C, only raised regions 54 extend from inside surface 44 of outside tube 42. However, in each instance, substantial concentricity is achieved between inside tube 30 and outside tube 42.

Figure 5:
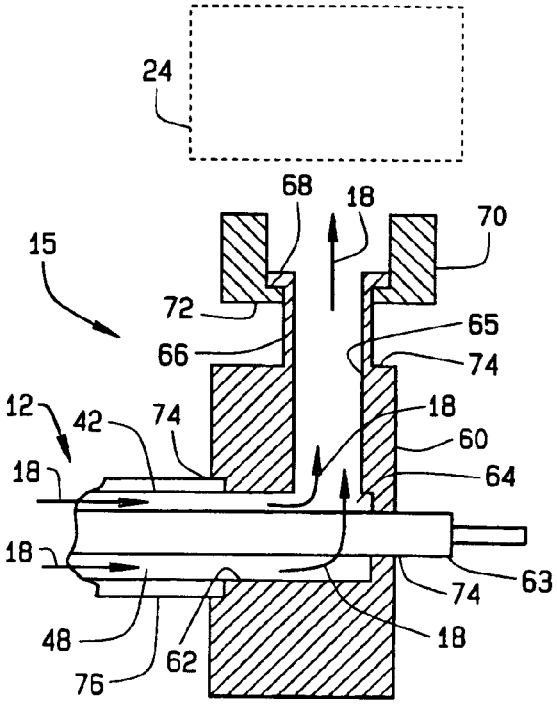
FIG. 5 is a cross-sectional view of a fitting taken along line 5—5 of FIG. 4 according to the present invention.

Referring to FIGS. 4 and 5, lower fitting 15 provides a means for coupling lower portion 26 of body 17 with inlet side 24 and comprises a body 60 for receiving a distal end 76 of fluid heat exchanger 12. Body 60 extends into a sleeve 66 for securing a connector 70 having a flange 72 that connects to respective inlet side 24 of the fluid heating system 10. Body 60 further defines a bore 62 which extends into a reduced bore 63. Another bore 65 is defined and intersects bore 62 such that an L-shaped passageway 64 is formed through body 60. Preferably, distal end 76 of fluid heat exchanger 12 is adapted to engage body 60 by removing a portion of outside tube 42 so that inside tube 30 protrudes outwardly from body 60. In assembly, exposed end of inside tube 30 is directed along bore 62 and through reduced bore 63 until outside tube 42 contacts body 60. Fluid tight seals 74 are then provided, preferably by a welding operation, between outside tube 42 and body 60 as well as between body 60 and inside tube 30 for maintaining a fluid tight seal.

As further shown, hollow sleeve 66 extends from bore 65 and includes a flange 68 for securing connector 70. Sleeve 66 and connector 70 collectively form a fluid tight seal along flanges 68, 72. Accordingly, fluid 18 flowing along passage 48 within fluid heat exchanger 12 passes through L-shaped passageway 64, sleeve 66, connector 70, through inlet side 24 to reach return side 22 of the fluid heating system 10. Although not shown, it is apparent that the only difference in operation between lower fitting 15 shown in FIG. 5 and upper fitting 14 in FIG. 4 is that the flow direction of fluid 18 is reversed.

Figure 6:
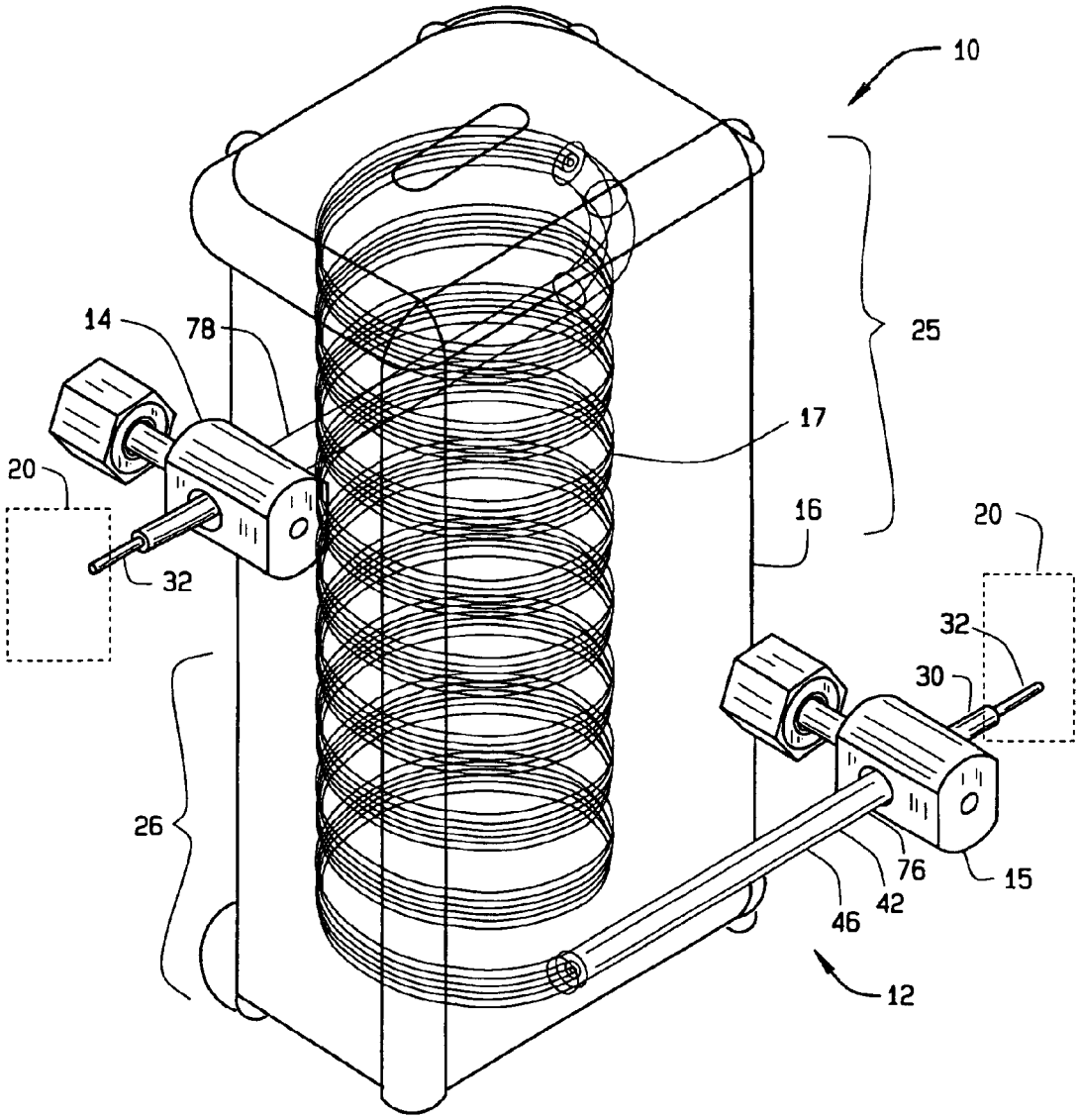
FIG. 6 is a transparent perspective view of the fluid heating system illustrating the interior components thereof according to the present invention.
Figure 7:
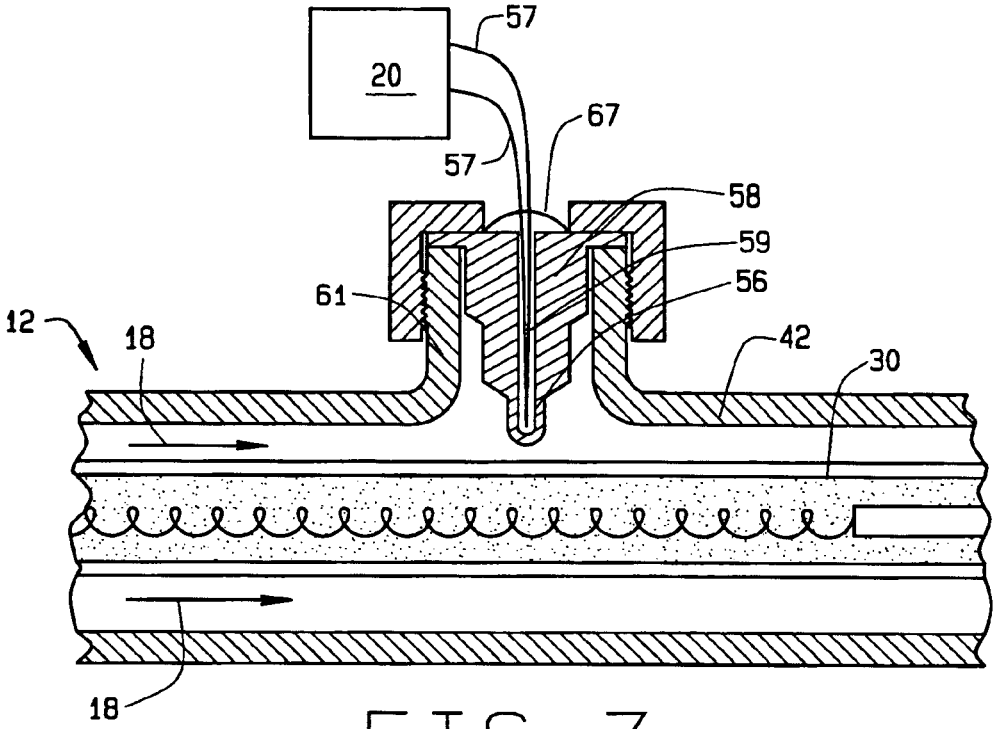
FIG. 7 is a diagram showing the operation of the temperature control system of the present invention.

Referring to FIGS. 6 and 7, the temperature control system 20 provides a means for controlling the temperature of fluid 18. Preferably, temperature control system 20 includes a plurality of sensors 56 for taking temperature readings of fluid 18. As shown in FIG. 7, sensors 56 may be located at any position along fluid heat exchanger 12 in the fluid 18 flow stream. Sensors 56, which may be thermocouples, resistance temperature detectors (RTDs) or thermistors, provide an electrical signal through electrical leads 57 connecting sensors 56 with temperature control system 20. When used to sense the temperature in the fluid 18 flow stream, sensors 56 are located in a thermowell 58 which defines a raised region 61 along outside tube 42. The dimensions of thermowell 58 are dependent upon the desired location within the fluid 18 flow stream that is to be monitored. Preferably, sensor 56 is placed substantially in fluid 18 flow stream, but not in contact with inside tube 30. Thermowell 58 may be configured so that electrical leads 57 extend through outside tube 42 for connection with temperature control system 20. To improve the accuracy and responsiveness of sensors 56, a thermal compound 59, which preferably is a liquid form of magnesium oxide, is placed in contact with each sensor 56 in order to conduct thermal energy from the passing fluid 18 to sensor 56. A plug material 67 is applied to the side opposite sensor 56 to prevent thermal compound 59 from leaking out of thermowell 58.

In addition to sensors 56 being placed in the fluid 18 flow stream, the present invention contemplates that sensors 56 may be placed within inside tube 30, such as the sensor placement disclosed in U.S. Pat. No. 6,104,011 to Juliano which is herein incorporated by reference. Fluid heating system 10 may incorporate any combination of these sensors 56. In this kind of fluid heating system 10, the temperature control system 20 controls the level of electrical power applied to cold portions 32 to precisely control the temperature of fluid 18. In operation, fluid heat exchanger 12 is either fully on or off, but may be rapidly shuttled between these on and off settings several times per second, if desired, in order to maintain precise control of the fluid temperature.

Figure 8:
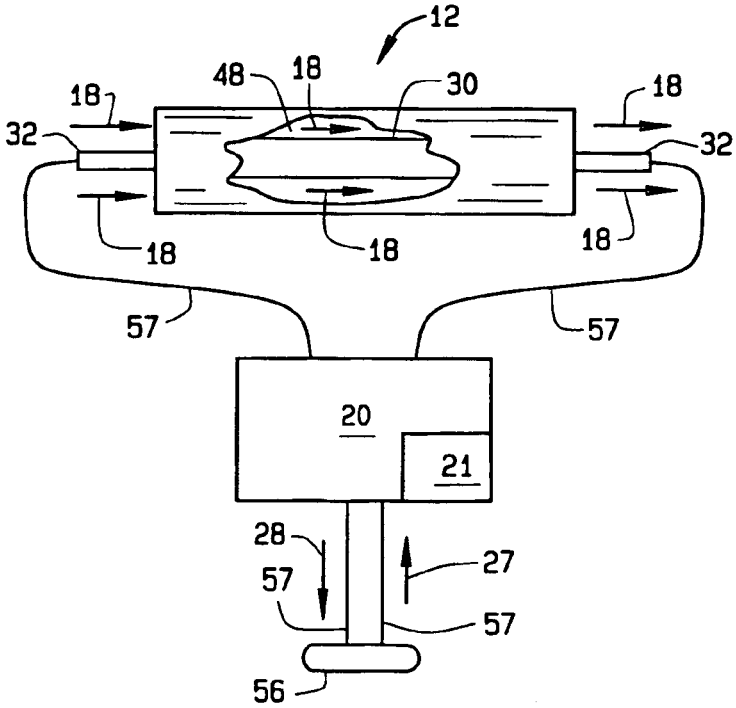
FIG. 8 is an additional diagram showing the operation of the temperature control system of the present invention.

Referring to FIG. 8, temperature control system 20 is preferably of known construction which contains a microprocessor-based controller 21 in order to achieve the desired fluid temperature control. Sensors 56 generate an electrical signal 27 in response to a sampling inquiry signal 28 from controller 21. Depending upon the extent of temperature control required, controller 21 may send hundreds or even thousands of signals 28 per second to sensors 56. The amount of time that passes between controller 21 signals is referred to as a sensing interval. If signal 27 from sensor 56 corresponds to a fluid temperature level below a predetermined level set in the temperature control system 20, control system 20 provides electrical power along leads 57 to respective ends of cold portion 32 which generates heat radially outward along the length of fluid heat exchanger 12. Accordingly, fluid 18 flowing along that portion of passageway 48 adjacent fluid heat exchanger 12 is heated. Once controller 21 receives signal 27 from sensor 56 that corresponds to a fluid temperature level that falls within the predetermined level set in the temperature control system 20, the temperature control system 20 removes electrical power from leads 57 so that fluid heat exchanger 12 no longer generates heat. Because this kind of fluid heat exchanger 12 provides a high concentration of convective heat per unit length, referred to as heat flux density, the fluid temperature may be raised to within the desired temperature range within thousandths of a second, depending on fluid velocity and thermal properties. Additionally, since this kind of fluid heat exchanger 12 is either fully on or off, the application of electrical power is preferably applied to fluid heat exchanger 12 in short pulses.

Before the fluid heat exchanger 12 can be energized, electrical signal 27 may need to be amplified and/or corrected before the temperature control system 20 can properly evaluate signal 27. A resistance temperature detector, or other suitable temperature sensor, T/C thermistors which calculate the temperature value based on resistance measurements, usually require a corrective calculation be performed to the resistance measurement in order to compensate for the length of leads 57. Thermistors, which are semiconductor chips sensitive to temperature fluctuations, generally require that signals 27 be amplified. Therefore, thermocouples are preferred because signals 27 do not require amplification or correction unless the length of the leads 57 exceeds a certain length. Further, thermocouples are less expensive to incorporate into fluid heating system 10.

Referring to FIGS. 1, 4, 7 and 8, in operation, fluid 18 flowing through fluid heating system 10 enters return side 22 through upper fitting 14 and flows along passageway 48 of fluid heat exchanger 12. When the temperature of fluid 18 falls below a predetermined level based on sensor 56 receiving a sampling inquiry signal 28 from controller 21 and generating electrical signal 27 in response, temperature control system 20 applies an electrical current along leads 57 to respective cold portions 32 which causes hot portion 34 to generate heat. Due to the limited cross sectional area provided by passageway 48 and the high density convective heat emitted radially outward from inside tube 30, the temperature of fluid 18 is nearly instantaneously brought to the desired temperature. Upon the desired temperature being reached, temperature control system 20 removes electrical current from cold portions 32. Temperature control system 20 then continually monitors and selectively applies electrical power to cold portions 32, as required to maintain the desired temperature level of fluid 18 flowing through passageway 48 from the inlet side 24 of the fluid heating system 10.

Referring specifically to FIG. 4, the preferred construction of the present invention utilizes an inside tube 30 having a 0.260 inches outside diameter and an outside tube 42 having an outside diameter of 0.5 inches; however, any number of suitable size variations are permissible. This construction permits outside tube 42 to have minimal thickness even in applications approaching 5,000 psi. In one high pressure application embodiment, fluid 18 is comprised of carbon dioxide which is pressurized and heated to a supercritical condition for use in semiconductor manufacturing applications. Further, outer surface 40 and inside surface 44 may be electropolished to minimize the possibility of trapping particulate matter along surfaces 40 and 44. In such an application, most components are comprised of stainless steel, although the present invention may utilize much lower temperatures, pressures and fluid compositions, such as in the food industry, which preferably use copper tubing requiring much lower temperatures and pressures.

It is apparent to one skilled in the art that the number of coils per unit length of wire 50 along the length of fluid heat exchanger 12 may vary considerably, depending on the magnitude of the bends, bend radii and materials used in fluid heat exchanger 12. Further, it should also be apparent that more than one wire 50 may be coiled along the length of fluid heat exchanger 12.

Although shown as being symmetrical along the peripheries of their respective surfaces, 40, 44, raised regions 52, 54 are not necessarily symmetrical, nor do regions 52, 54 necessarily proceed longitudinally along the centerline of tubes. In other words, raised regions 52, 54 may proceed in helical fashion similar to the path of wire 50. Further, although depicted as trapezoidal in shape, raised regions 52, 54 could have any number of different profiles and fall within the scope of the present invention.

Comparative Testing

The rapid response fluid heating system of the present invention, absent insulation layer 16 to provide conservative results, was tested in comparison with a conventional circulation heat exchanger 100 (FIG. 9) and a cast-in circulation heat exchanger 200 (FIG. 10), each designed by Watlow Electric Manufacturing Company.

Figure 9:
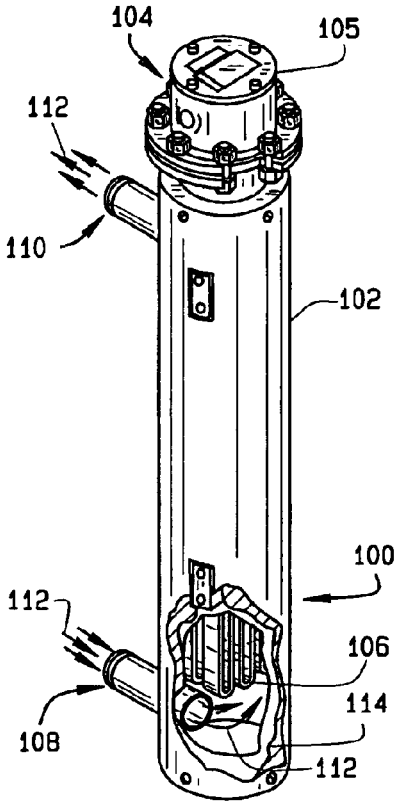
FIG. 9 PRIOR ART
FIG. 9 is a perspective view of a prior art circulation heat exchanger.
Figure 9A:
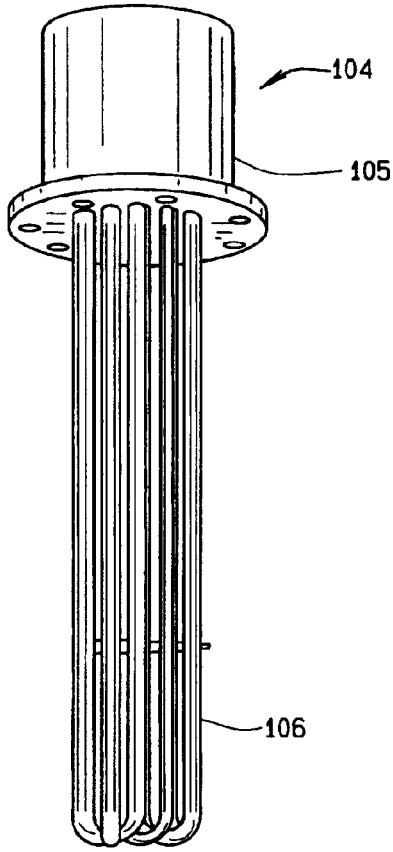
FIG. 9A PRIOR ART
FIG. 9A is a perspective view of a heating element portion for insertion into a prior art circulation heater.

Referring to FIGS. 9 and 9A, prior art circulation heat exchanger 100 defines a hollow cylindrical body 102 into which is inserted a heating element portion 104 having numerous heating elements 106 extending from a cap 105 for heating a fluid 112. Fluid 112 enters body 102 through inlet tube 108 and is heated by heating elements 106 as fluid 112 flows along body 102 before exiting body 102 through outlet tube 110. To improve the efficiency of circulation heater 100, an insulating layer 114 surrounds body 102.

Figure 10:
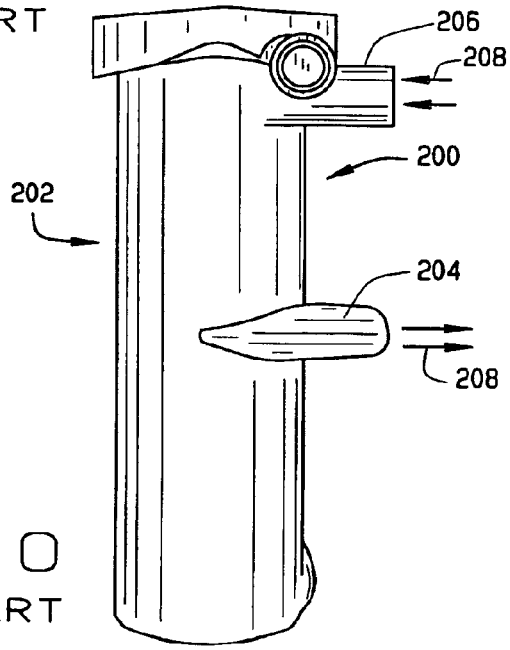
FIG. 10 PRIOR ART
FIG. 10 is a perspective view of a prior art cast-in heat exchanger.

Referring to FIG. 10, the prior art cast-in circulation heat exchanger 200 defines a cylindrical body 202. Fluid 208 enters body 202 through inlet tube 206, flows along a length of body 202 before exiting through outlet 204. Heating elements (not shown) which heat fluid 208 as fluid 208 flows along body 202 are formed within the walls of body 202.

The testing parameters common to each heating configuration are as follows:

1) inlet water temperature is 57.5 degrees Fahrenheit;

2) exit water temperature is 90 degrees Fahrenheit;

3) water flow rate is 3 liters/minute;

4) heat exchanger has a watt density of 60 Watts/sq. inch;

5) heat exchanger operates at 4 kilowatts;

6) sensing device monitors water temperature once each second; and 7) power supply supplies AC voltage incrementally at +/−1 volt.

Watt density may be calculated by dividing the rated wattage of the heat exchanger by the product of the quantity of the length of heating elements (Heated Length; HL), diameter (D) of the heating element and pi (π):

$$\text{Watt density}=\text{Watt}/(\pi^{*}D^{*}HL)$$

To ensure common testing conditions, each of the heat exchangers was designed to be energized at an identical voltage which corresponds to an identical wattage. The amount of watts or power at which the heat exchanger operates will dictate the temperature of the heating elements that will heat the water. The watt density will dictate the amount of power that the heat exchanger will disperse per every square inch of heat exchanger length or the response of the heat exchanger element.

If each heat exchanger is energized such that the watt density is identical, the difference in response time, that is, the time required to heat the water from the initial temperature to the desired temperature, is affected only by the heat exchanger configuration.

Figure 11:
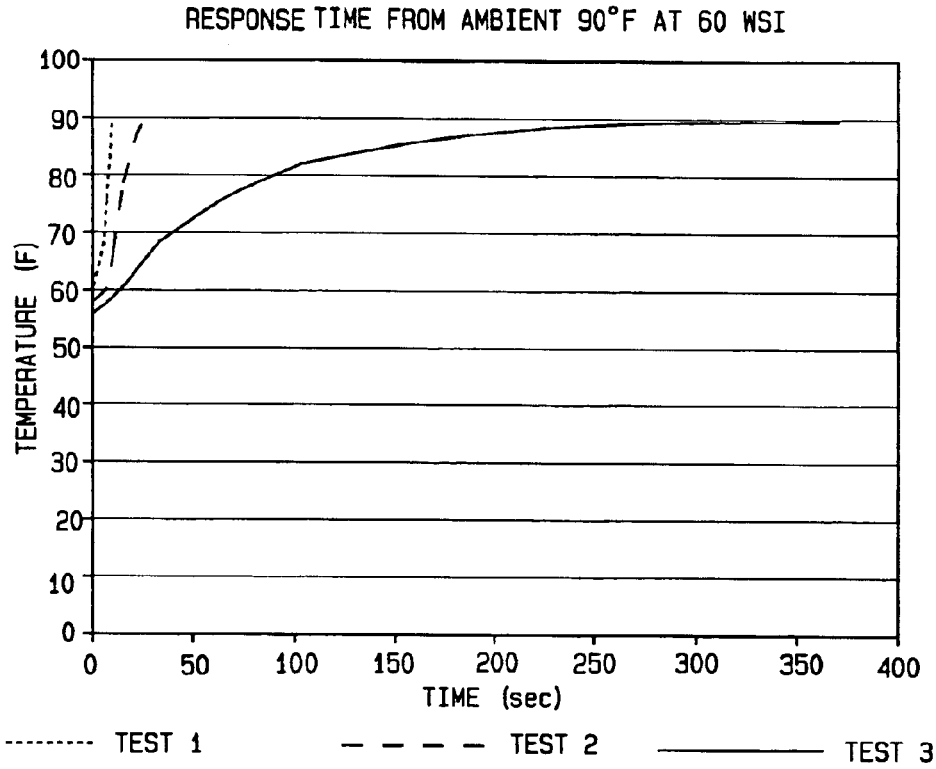
FIG. 11 is a graph illustrating temperature level readings measured at time intervals comparing heat exchanger response between several heat exchanger configurations.

Referring to FIG. 11 the response time for each heat exchanger configuration to bring water from 57.5 to 90 degrees Fahrenheit is illustrated. Test 1 corresponds to the rapid response heat exchanger of the present invention, Test 2 corresponds to the circulation heat exchanger, while Test 3 corresponds to the cast-in heat exchanger. As is readily apparent, the response time for the rapid response heat exchanger (10 seconds) is significantly less than the responses for the other heat exchangers (30 seconds and 371 seconds, respectively).

Figure 12:
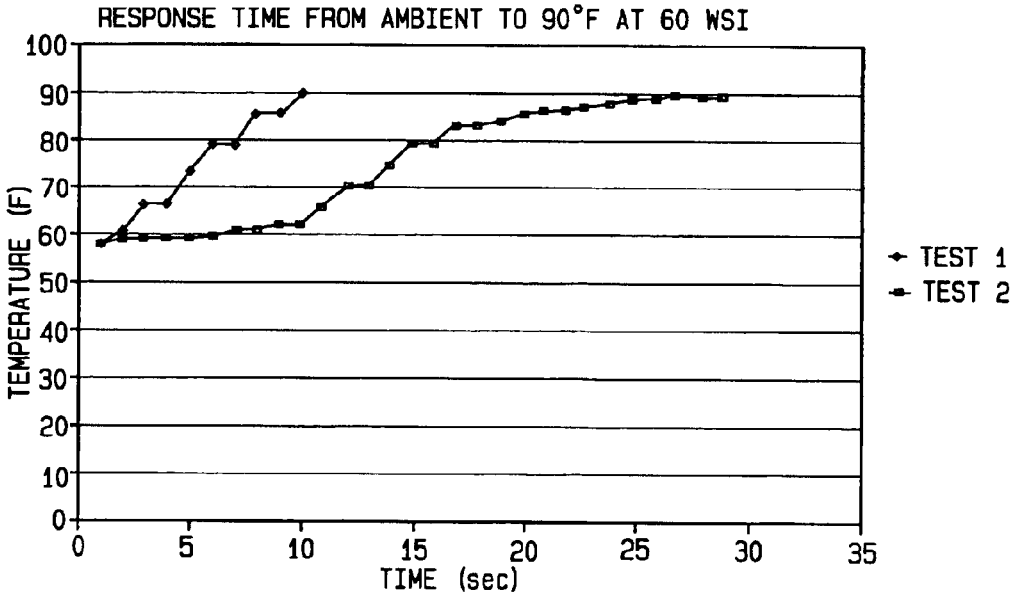
FIG. 12 is a graph illustrating temperature level readings measured at a narrower time interval for comparing heat exchanger response readings between the prior art circulation heat exchanger and the fluid heat exchanger according to the present invention.

Referring to FIG. 12, the difference in response time is more clearly shown between the rapid response heat exchanger (Test 1) and the circulation heat exchanger (Test 2). Note that the prior art circulation heat exchanger took three times longer to heat water to the desired temperature than the rapid response heat exchanger of the present invention. Moreover, in the time that the rapid response heat exchanger heated the water to the desired temperature, an increase in temperature of 32.5 degrees Fahrenheit, the circulation heat exchanger of the prior art had warmed the water to approximately 3.5 degrees Fahrenheit, or approximately 10 percent that of the rapid response heat exchanger. Further, unlike the inconsistent water heating trend exhibited by the circulation heat exchanger over the recorded time period, the rapid response heat exchanger rapidly heated the water in a substantially linear trend, therefore providing a more stable heating configuration. Finally, this significant improvement in response time as exhibited by the rapid response heat exchanger was obtained without the benefit of an insulating layer 16 (FIG. 4) surrounding the outer tube. The circulation heat exchanger 100 (FIG. 9) was provided with insulating layer 114. It is estimated that the addition of an insulating layer 16 to the rapid response heat exchanger 10 could improve the response time by 10 percent or more.

Therefore, it is readily apparent that the significantly improved response times, especially at lower fluid flow rates, and uniform heating profile of the rapid response heat exchanger of the present invention are due, in large part, to its efficient, compact design. The present invention focuses heat energy generated by the inside heating tube directly to the fluid passing between the inside heating tube and the outside tube so that less heat energy is used to heat other components in the fluid heat exchanger.

Further Comparative Testing

To further illustrate the thermal efficiency of the rapid response heater, the convective film coefficient may be used.

The convective film coefficient ($h_c$) is a measure of the efficiency of a heat exchange system that makes use of convection as the primary means of exchanging thermal energy. This coefficient is measured along the outer peripheral surface of the heating element which is in contact with the working fluid circulating through the heat exchange system. For purposes herein, the convective film coefficient is derived from a variation of the Dittus-Boelter equation:

$$Nu_D=0.023^{*}Re_D0.8^{*}Pr^{n}$$

$Nu_D$ represents the Nusselt number which is a local heat transfer coefficient, $Re_D$ represents the Reynolds number that is a measure of the magnitude of the inertia forces in the fluid to the viscous forces, and Pr represents the Prandtl number for defining the ratio of kinematic viscosity to the thermal diffusivity. Each of these numbers is dimensionless. The constant "n" equals 0.4 if the equation is used for heating and 0.3 if used for cooling.

The Prandtl number may be further expressed:

$$Pr=\mu*C_p/K$$

wherein $\mu$ represents absolute viscosity and may be expressed as (lb/ft-hr), $C_p$ represents specific heat capacity and may be expressed as (BTU/lb-° F.), and K represents thermal conductivity and may be expressed as (BTU/ft-hr-° F.).

The Reynolds number may be further expressed:

$$Re_D=G*D_e/\mu$$

wherein G represents mass flow rate and may be expressed as (lb/ft$^2$-hr), $D_e$ represents hydraulic or equivalent diameter and may be expressed as (ft), and $\mu$ represents absolute viscosity.

Substituting for $Re_D$ and Pr yields $h_c$:

$$h_c=0.023*G^{0.8}*C_p^{0.33}*K^{0.67}/(D_e^{0.2}*\mu^{0.47})$$

The rapid response fluid heating system 10 of the present invention (FIGS. 13, 14) was tested with a conventional cast-in circulation heat exchanger (FIGS. 15, 16) each designed by Watlow Electric Manufacturing Company by comparing respective convective film coefficients.

Figure 13:
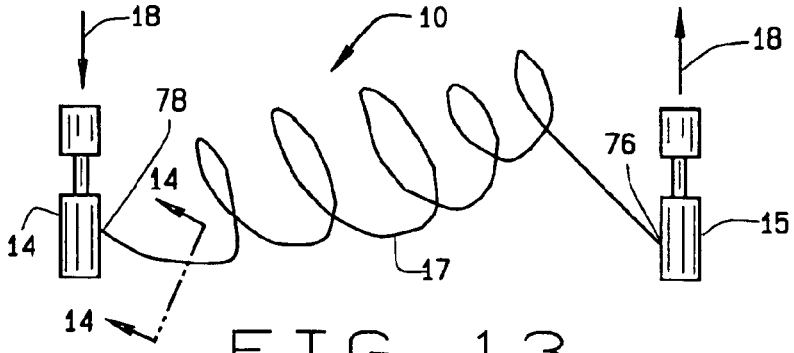
FIG. 13 is a perspective view of a fluid heating system without the insulating layer according to the present invention.
Figure 14:
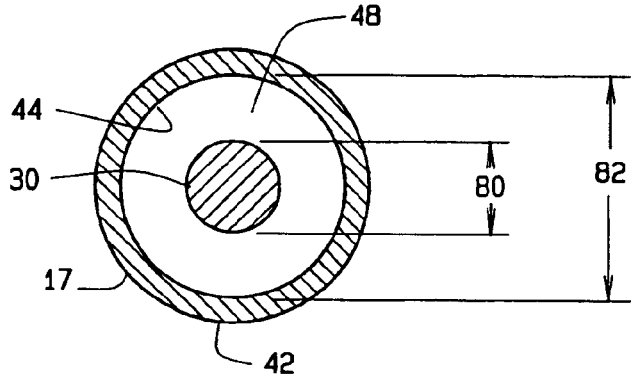
FIG. 14 is a cross-sectional view of the inside and outside tubes taken along line 14—14 of FIG. 13 according to the present invention.

Referring to FIGS. 13 and 14, the rapid response heating system 10 of the present invention defines a coiled elongated body 17 having a distal end 76 connecting to a lower fitting 15 and an opposed proximal end 78 connecting to an upper fitting 14. Body 17 defines a heatable inside tube 30 for heating fluid 18 having a diameter 80 which is surrounded by a hollow outside tube 42 having an inside diameter 82. Fluid 18 enters upper fitting 14, passes along a passageway 48 defined between inside tube 30 and outside tube 42. As fluid 18 passes along passageway 48 it is heated before reaching lower fitting 15 and exiting body 17.

Figure 15:
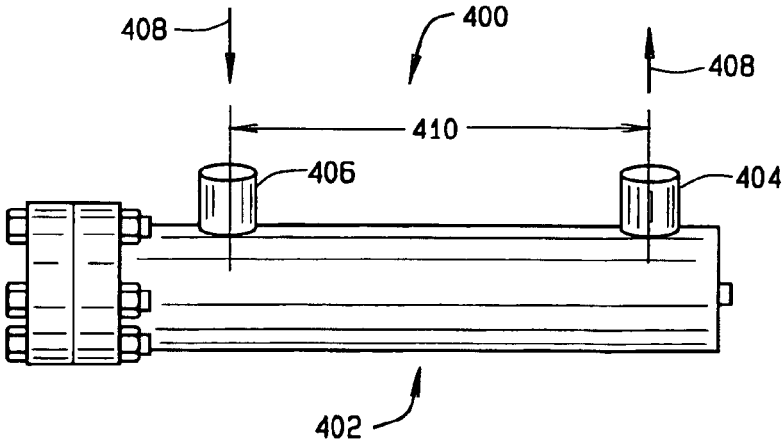
FIG. 15 PRIOR ART
FIG. 15 is a side view of a prior art cast-in heat exchanger.
Figure 16:
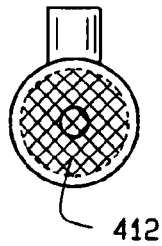
FIG. 16 is an end view of the prior art cast-in heat exchanger.

Referring to FIGS. 15 and 16, the prior art cast-in circulation heat exchanger defines a cylindrical body 402 having an effective free cross-section area ($A_F$) 412. Fluid 408 enters body 402 through inlet tube 406, flows along a length 410 of body 402 before exiting through outlet 404. Heating elements (not shown) which heat fluid 408 as fluid 408 flows along body 402 are found within the walls of body 402. The term "heated length" refers to the total length of the heating elements required to heat the fluid.

The testing parameters common to each heating configuration are as follows:

1) fluid 18, 408 is air;
2) inlet air temperature ($T_{in}$) is 68° F.;
3) exit air temperature ($T_{out}$) is 500° F.;
4) volumetric fluid flow rate ($F_R$) is 100 cubic feet per minute (CFM). CFM is measured at standard temperature and pressure (STP) and may be expressed as (SCFM);
5) total energy (Q) for each heat exchanger configuration is identical;
6) heating element sheath temperature ($T_s$) is maintained at 1,000° F.; and
7) fluid (air) is pressurized to 500 psig.

Among the general assumptions made for this comparison include:

1) the cross-sectional profiles for all tubes, heating elements, and the body 402 of the prior art heat exchanger are circular; and
2) referring to FIG. 17, a table listing the values for specific heat capacity, $C_p$, thermal conductivity, K, absolute viscosity, $\mu$, and density, $\rho$, of air at various temperatures at 500 psig is used to provide this information hereinbelow.

To calculate the total energy (Q) required by the respective heating systems to the air:

$$Q=M*C_p*\Delta T$$

wherein M represents the mass flow rate of air at STP, $C_p$ represents specific heat capacity, and $\Delta T$ represents change in temperature.

$$M = F_R*\rho = (100\ \text{ft}^3/\text{min})*(60\ \text{min/hr})*(0.075\ \text{lb/ft}^3)$$
$$= 450\ \text{lb/hr}$$

Specific heat capacity is calculated from the log mean temperature difference ($\Delta T_{LM}$) as follows:

$$\Delta T_{LM} = (T_{out} - T_{in})/\ln(T_{out} - T_{in})$$
$$= (500 - 68^\circ\ \text{F.})/\ln(500 - 68^\circ\ \text{F.}) = 216^\circ\ \text{F.}$$

Accordingly, the total energy may then be calculated:

$$Q = M*Cp*\Delta T$$
$$= ((450\ \text{lb/hr})*(0.243\ \text{BTU/(lb-}^\circ\ \text{F.})*(500 - 68^\circ\ \text{F.})/(3412\ \text{BTU/hr/1 kW}))$$
$$= 13.84\ \text{kW-hr}$$

Referring to FIGS. 15, 16, the convective film coefficient ($h_c$) may be calculated for the prior art cast-in circulation heat exchanger by selecting typical values for the effective cross-sectional area 412 ($A_F$) of 0.044 ft$^2$ and hydraulic diameter ($D_e$) of 0.17 ft. This calculation is accomplished by first calculating the mass flow rate (G) and then the Reynolds number ($Re_D$).

$$G = M/A_F = 450\ \text{lb/hr}/0.44\ \text{ft}^2 = 10{,}227\ \text{lb/ft}^2\text{-hr}$$
$$Re_D = G*D_e/\mu$$
$$= (10{,}227\ \text{lb/ft}^2\text{-hr})*(0.17\ \text{ft})/0.0977\ \text{lb/ft-hr} = 17{,}795$$

Because the Reynolds number calculated above is greater than 2,300, the flow is considered turbulent, and permits application of the formula for the convective heat film coefficient.

$$h_c = 0.023*G^{0.8}*C_P^{0.33}*K^{0.67}/(D_e^{0.2}*\mu^{0.47})$$
$$= (0.023)*(10{,}227\ \text{lb/ft}^2\text{-hr})^{0.8}*(0.264\ \text{BTU/lb-}^\circ\ \text{F.})^{0.33}*(0.0180\ \text{BTU/ft-hr-}^\circ\ \text{F.})^{0.67}/((0.17\ \text{ft})^{0.2}*(0.0977\ \text{lb/ft-hr})^{0.47})$$
$$= 6.89\ \text{BTU/ft}^2\text{-hr-}^\circ\ \text{F.}$$

Once the convective heat film coefficient for the prior art heat exchanger has been calculated, the maximum heat flux, also referred to as watt density, typically measured in watts/in$^2$ (WSI), may be calculated. By then considering the diameter (DIA) of the heating element, in this case 0.475 inches, the heated length (HL) of the heating elements may also be calculated.

$$\begin{aligned} Heat\ flux_{max} &= (h_c)*(T_s - T_{out}) \\ &= (6.89\ \text{BTU/ft}^2\text{-hr-}^\circ\ \text{F.})*(1000-500^\circ\ \text{F.})/ \\ &\quad ((3.412\ \text{BTU/hr/1 W})*(144\ \text{in}^2/1\ \text{Ft}^2)) \\ &= 7.01\ \text{WSI} \end{aligned}$$

$$\begin{aligned} HL &= Q/(DIA)*\pi*Heat\ flux_{max} \\ &= 13{,}840\ \text{W}/((0.475\ \text{inch})*(\pi)*(7.01\ \text{WSI}) \\ &= 1{,}323.04\ \text{in} \end{aligned}$$

Referring to FIGS. 13, 14, the convective heat film coefficient ($h_c$) of the rapid response fluid heating system of the present invention may be calculated once the effective cross-sectional area ($A_F$) has been calculated, as all other parameters require this information. The effective cross-sectional area which is defined by passageway 48 may be calculated by selecting values for diameter 80 ($D_1$) of heatable tube 30 of 0.26 inches and inside diameter 82 ($D_2$) of outside tube 42 of 0.495 inches.

$$\begin{aligned} A_F &= \pi/4*((D_2)^2-(D_1)^2) \\ &= (.7854)*((0.495\ \text{in})^2-(0.260\ \text{in})^2)/144\ \text{in}^2/1\ \text{ft}^2 \\ &= 9.64\ \text{E}-04\ \text{ft}^2 \end{aligned}$$

$$D_e = D_2 - D_1 = 0.495\ \text{in} - 0.260\ \text{in} = 0.235\ \text{in} = 0.0195\ \text{ft}$$

$$G = M/A_F = 450\ \text{lb/hr}/9.64\ E-04\ \text{ft}^2 = 466{,}805\ \text{lb/ft}^2\text{-hr}$$

$$Re = (466{,}805\ \text{lb/ft}^2\text{-hr})*(0.0195\ \text{ft})/0.0977\ \text{lb/Ft-hr} = 93{,}169$$

$$\begin{aligned} h_c &= 0.023*G^{0.8}*C_P^{0.33}*K^{0.67}/(D_e^{0.2}*\mu^{0.47}) \\ &= (0.023)*(446{,}805\ \text{lb/ft}^2\text{-hr})^{0.8}*(0.264\ \text{BTU/lb-}^\circ\ \text{F.})^{0.33}* \\ &\quad (0.0180\ \text{BTU/ft-hr-}^\circ\ \text{F.})^{0.67}/ \\ &\quad ((0.0195\ \text{ft})^{0.2}*(0.0977\ \text{lb/ft}-\text{hr})^{0.47}) \\ &= 226.05\ \text{BTU/ft}^2\text{-hr-}^\circ\ \text{F.} \end{aligned}$$

Once the convective heat film coefficient has been calculated, the maximum heat flux and the heated length (HL) of the heating elements may then be calculated.

$$\begin{aligned} Heat\ flux_{max} &= (h_c)*(T_s - T_{out}) \\ &= (226.05\ \text{BTU/ft}^2\text{-hr-}^\circ\ \text{F.})*(1000-500^\circ\ \text{F.})/ \\ &\quad ((3.412\ \text{BTU/hr/1 W})*(144\ \text{in}^2/1\ \text{ft}^2)) \\ &= 230.05\ \text{WSI} \end{aligned}$$

$$\begin{aligned} HL &= Q/(D_1)*\pi*Heat\ flux_{max} \\ &= 13{,}840\ \text{W}/((0.260\ \text{in})*(\pi)*(230.05\ \text{WSI}) \\ &= 73.65\ \text{in} \end{aligned}$$

As these test conditions indicate, the rapid response heating system of the present invention requires approximately 18 times less heated length than the length required by the prior art cast-in heater. Therefore, under similarly low flow rate conditions, the rapid response heater provides significantly improved, stable, response times over prior art heat exchangers. However, equally significantly, the rapid response heater accomplishes these unexpected significant improvements in much reduced space due to the greatly reduced heated lengths, in addition to the capability to form the tubes in almost any shape.

It is impossible, for practical purposes, to define a precise meaning for "low fluid flow rate" as contained herein because each application takes into account the heating system geometry, heating parameters, and the type of working fluid, which may be unique. However, as the fluid flow rate increases and as the passageway 48 (FIG. 14) increases in cross-sectional area, especially in comparison with the effective length of the heatable inside tube 30, the rapid response heater of the present invention will begin to resemble prior art configurations. At this point, most of the advantages with regard to size and overall efficiency is significantly reduced.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed is:

1. A fluid heat exchanger for use in a fluid heating system comprising:

a rapidly heatable inside tube including a hot portion for generation heat in combination with an unheated cold portion for providing power to said hot portion; said hot portion being continuous through said rapidly heatable inside tube and having opposing ends connected to said cold portion, said rapidly heatable inside tube having at lest one portion with and axial curvature along the length of said hot portion;

a hollow outside tube surrounding said cold portion and said hot portion of said rapidly heatable inside tube;

a fluid passing between said rapidly heatable inside tube and said outside tube for circulation through said fluid heating system;

wherein said rapidly heatable inside tube is rapidly heated by said hot portion so that said rapidly heatable inside tube is heated throughout its continuous length and said fluid is rapidly heated as it passes over said hot portion to a predetermined temperature for use in said fluid heating system.

2. The fluid heat exchanger according to claim 1 wherein said outside tube is thin-walled.

3. The fluid heat exchanger according to claim 1 wherein said rapidly heatable inside and outside tube have respective circular cross sections.

4. The fluid heat exchanger according to claim 1 wherein said outside tube concentrically surrounds said rapidly heatable inside tube.

5. The fluid heat exchanger according to claim 1 further comprising an insulating layer surrounding said outside tube.

6. The fluid heat exchanger according to claim 1 wherein said cold portion has an opposing proximal end and distal end, said distal end of said cold portion extending outwardly from said rapidly heatable inside tube, said hot portion being interposed between said cold portion for connection with respective said proximal ends of said cold portion within said rapidly heatable inside tube; wherein said cold portion receives electrical power from an electrical power source for rapidly heating said rapidly heatable inside tube.

7. The fluid heat exchanger according to claim 1 wherein said outside tube defines an inside surface and said rapidly heatable inside tube defines an outside surface, said inside and outside surface being electropolished.

8. The fluid heat exchanger according to claim 1 wherein said fluid may be raised to a supercritical condition by said rapidly heatable inside tube.

9. The fluid heat exchanger according to claim 1 wherein said fluid heat exchanger is of compact construction.

10. The fluid heat exchanger according to claim 1 further comprising a temperature control system having at least one sensor located along said fluid heat exchanger in sensing communication with said fluid, said temperature control system controlling the operation of said heatable inside tube by regulating said fluid temperature within a predetermined range based on fluid temperature readings taken by said temperature control system; wherein said inside tube is rapidly heated by said temperature control system; wherein said rapidly heatable inside tube is rapidly heated by said temperature control system such that said fluid is rapidly heated to within said predetermined range for use in said fluid heating system.

11. The fluid heat exchanger according to claim 4 further comprising at least one coiled wire interposed between said inside tube and said outside tube for maintaining concentricity between said inside and outside tubes.

12. The fluid heat exchanger according to claim 4 wherein said inside tube defines an outside surface having longitudinally spaced raised regions extending outwardly therefrom such that concentricity is maintained between said inside and outside tubes.

13. The fluid heat exchanger according to claim 6 wherein said hot portion coils longitudinally within said rapidly heatable inside tube.

14. The fluid heat exchanger according to claim 8 wherein said fluid comprises carbon dioxide.

15. The fluid heat exchanger according to claim 12 wherein said raised regions proceed helically along said outside tube.

16. The fluid heat exchanger according to claim 12 wherein said outside tube defines an inside surface, said inside surface having longitudinally spaced raised regions extending inwardly therefrom to maintain concentricity between said inside and outside tubes.

17. The fluid heat exchanger according to claim 16 wherein said raised regions proceed helically along said outside tube.

18. A fluid heating system comprising:

a fluid heat exchanger defining a rapidly heatable inside tube including a hot portion for generating heat in combination with an unheated cold portion for providing power to said hot portion, said hot portion being continuous through said rapidly heatable inside tube having at least one portion with an axial curvature along the length of said hot portion;

a hollow inside tube surrounding said cold portion and said hot portion of said rapidly heatable inside tube;

a fluid passing between said inside tube and said outside tube for circulation through said fluid heating system;

a temperature control system having at least one sensor located along said fluid heat exchanger in sensing communication with said fluid, said temperature control system controlling the operation of said heatable inside tube by regulating said fluid temperature within a predetermined range based on fluid temperature readings taken by said temperature control system;

wherein said inside tube is rapidly heated by said hot portion and controlled by said temperature control system such that said fluid is rapidly heated to within said predetermined range as it passes over said hot portion for use in said fluid heating system.

19. The fluid heating system according to claim 18 wherein said at least one sensor is positioned in the fluid flow stream.

20. The fluid heating system according to claim 18 wherein said at least one sensor is located within said outside tube.

21. The fluid heating system according to claim 18 wherein said temperature control system further comprises a microprocessor-based controller.

22. The fluid heating system according to claim 18 wherein said at least one sensor may be located in the fluid flow stream and within said outside tube.

23. The fluid heating system according to claim 18 wherein said at least one sensor comprises a thermistor.

24. The fluid heating system according to claim 18 wherein said at least one sensor comprises a resistance temperature detector.

25. The fluid heating system according to claim 18 wherein said at least one sensor comprises a thermocouple.

26. The fluid heating system according to claim 18 wherein said fluid heating system raises the temperature level of said fluid in a substantially linear trend per unit of time.

27. The fluid heating system according to claim 19 wherein said at least one sensor is located in a raised region formed along said outside tube.

28. A fluid heat exchanger for use in a fluid heating system comprising:

a rapidly heatable inside tube including a hot portion for generating heat in combination with an unheated cold portion for providing power to said hot portion, said hot portion being continuous through said rapidly heatable inside tube and having opposing ends connected to said cold portion, said rapidly heatable inside tube having at least one portion with and axial curvature along the length of said hot portion;

a hollow outside tube closely surrounding said cold portion and said hot portion of said rapidly heatable inside tube, said inside and outside tubes collectively formable in a number of shapes;

said rapidly heatable inside tube and said outside tube defining a passageway for a fluid passing therebetween for circulation through said fluid heating system;

wherein said rapidly heatable inside tube is rapidly heated by said hot portion so that said rapidly heatable inside tube is heated throughout its continuous length for heating said fluid to a predetermined temperature as said fluid passes over said hot portion for use in said fluid heating system.

29. The fluid heating system according to claim 28 wherein said passageway defines a small cross-sectional area for said fluid to pass therethrough.

30. The fluid heating system according to claim 28 wherein said shapes collectively formable with said inside and outside tubes define a compact construction.

31. The fluid heating system according to claim 29 wherein said passageway defines an annular cross-sectional area.

32. The fluid heating system according to claim 29 wherein the convective film coefficient along the outer periphery of said rapidly heatable inside tube is a large value.

33. A fluid heat exchanger for use in a fluid heating system comprising:

a rapidly heatable inside tube having an outer peripheral surface including a hot portion for generating heat in combination with an unheated cold portion for providing power to said hot portion, said hot portion being continuous through said rapidly heatable inside tube and having opposing ends connected to said cold portion, said rapidly heatable inside tube having at least one portion with and axial curvature along the length of said hot portion;

a hollow outside tube closely surrounding said cold portion and said hot portion of said rapidly heatable inside tube substantially concentrically, said inside and outside tubes collectively formable in a number of shapes;

said rapidly heatable inside tube and said outside tube defining a passageway having a small cross-sectional area therebetween;

a fluid passing along said passageway for circulation through said fluid heating system that is heated as it passes over said hot portion;

a temperature control system having at least one sensor located along said fluid heat exchanger in sensing communication with said fluid, said temperature control system controlling the operation of said rapidly heatable inside tube by regulating said fluid temperature within a predetermined range based on fluid temperature readings taken by said temperature control system;

wherein said outer peripheral surface of said rapidly heatable inside tube having a high convective film coefficient value is rapidly heated by said hot portion so that said rapidly heatable inside tube is heated throughout its continuous length by said temperature control system such that said fluid is rapidly heated to within said predetermined range for use in said fluid heating system.

* * * * *

UNITED STATES PATENT AND TRADEMARK OFFICE

CERTIFICATE OF CORRECTION

PATENT NO. : 6,944,394 B2
DATED : September 13, 2005
INVENTOR(S) : Dennis P. Long et al.

It is certified that error appears in the above-identified patent and that said Letters Patent is hereby corrected as shown below:

Column 12,
Line 28, replace “generation” with -- generating --.
Line 33, replace “lest” with -- least --, and replace “and axial curvature” with -- an axial curvature --.
Line 49, replace “tube” with -- tubes --.

Column 13,
Line 2, replace “surface” with -- surfaces --.
Line 7, insert -- a -- between “of” and “compact construction”.
Line 16, insert -- and -- between “;” and “wherein”.
Line 37, replace “outside tube” with -- inside tube”.
Line 54, replace “hollow inside tube” with -- hollow outside tube --.

Column 14,
Line 36, replace “and axial curvature” with -- an axial curvature --.
Line 67, replace “surface including” with -- surface and including --.

Signed and Sealed this

Thirty-first Day of January, 2006

JON W. DUDAS
*Director of the United States Patent and Trademark Office*